US005322179A

United States Patent [19]

Ting

[11] Patent Number: 5,322,179

[45] Date of Patent: Jun. 21, 1994

[54] GARBAGE CAN WITH GARBAGE BAGS AUTOMATICALLY DEPOSITED WITHOUT MANUAL HANDLING

[76] Inventor: Chi-En Ting, 79, Alley 2, Sheng-Li Street, Yung-Kang Shiang, Tainan Shien, Taiwan

[21] Appl. No.: 78,148

[22] Filed: Jun. 17, 1993

[51] Int. Cl.[5] ..... B65F 1/06

[52] U.S. Cl. ..... 220/407; 220/264; 220/410; 220/23.83; 220/908

[58] Field of Search ..... 248/147, 99, 100, 101; 220/23.83, 23.86, 407, 404, 403, 408, 410, 262, 263, 264, 908

[56] References Cited

U.S. PATENT DOCUMENTS

| | | | |
|---|---|---|---|
| 1,606,291 | 11/1926 | Burrows | 220/264 |
| 3,576,290 | 4/1971 | Marchisen | 220/404 |
| 3,800,503 | 4/1974 | Maki | 220/407 |
| 3,807,598 | 4/1974 | Nutt | 220/404 |
| 3,836,037 | 9/1974 | Bass | 220/410 |
| 4,848,709 | 7/1989 | Kiniry | 248/101 |
| 5,170,904 | 12/1992 | Neuhaus | 220/264 |
| 5,213,228 | 5/1993 | Chang | 220/404 |

FOREIGN PATENT DOCUMENTS

| | | | |
|---|---|---|---|
| 2146823 | 3/1973 | Fed. Rep. of Germany | 220/407 |
| 3701363 | 9/1988 | Fed. Rep. of Germany | 220/407 |
| 0162602 | 6/1989 | Japan | 220/407 |
| 257081 | 8/1926 | United Kingdom | 220/264 |

*Primary Examiner*—Stephen Castellano

[57] ABSTRACT

A garbage can having an outer can, an inner can to be contained and hung in the outer can normally closed by two half caps being opened by a lever with a pedal stepped down to open the two half caps outward with a adhesive bar thereof closing and opening an open upper end of a garbage bag adhered to the bars simultaneously, and a garbage bag roll being stored below the inner can on the bottom of the outer can supplying garbage bags one by one continuously through a slot in the bottom of the inner cap.

3 Claims, 5 Drawing Sheets

GARBAGE CAN WITH GARBAGE BAGS AUTOMATICALLY DEPOSITED WITHOUT MANUAL HANDLING

BACKGROUND OF THE INVENTION

A commonly known garbage can shown in FIG. 1 comprises a can 1 with a elongate slot in its bottom, an extended body portion 11 under the bottom, two round projections 12, 13 respectively provided on two diametrically opposite inner walls of the extended body portion 11 for hanging a roller for a garbage bag roll 14. In using, the top end of the garbage bag roll 14 is pulled through the slot upward to place an upper open end of one garbage bag of the roll 14 to be folded around the upper round edge of the can 1. After the first bag is filled full of garbage, it is taken off the can 1, with the bottom end torn from the next one wound around the garbage bag roll 14.

However, this conventional garbage bag has undesirable features as follows.

1. A garbage bag has to be manually handled to be folded with its upper open end around an upper circumferential edge of the can every time a bag is to be replaced.

2. A punched cut line of a garbage bag is no so easy to be torn off when one bag is full and to be taken away from the can.

3. A bag pulled and placed in the can is always open without a cap, liable to attract flies and mosquitoes to fly around garbage thrown in the bag, quite insanitary.

SUMMARY OF THE INVENTION

This invention has been devised to offer a kind of garbage can normally closed when not in use, and only opened by foot when to be used, to keep it very sanitary.

One of the special feature of the garbage can in the present invention is that the two half caps and an upper end of a garbage bag are closed and opened at the same time without manual handling.

Another special feature is the upper end of a garbage bag is closed substantially tight to prevent flies and mosquitoes to swarm around garbage stored in the bag.

A main constructional advantage of the garbage can in the present invention is provision of a lever connected with a pedal to move two pairs of two connecting rods with bottom ends pivotally connected with the lever and upper ends pivotally connected with pivotal shafts of position means connected with two half caps normally closed an open upper side of an outer can containing an inner can hung around an inner circumferential groove of the outer can. When the pedal is pressed down by foot, the two half caps are swung outward with a respective adhesive bar adhering an upper end of a garbage bag to open the bag at the same time. A garbage bag is continuously pulled from a bag roll hung on a roller disposed below the inner can on the bottom of the outer can.

DETAILED DESCRIPTION OF THE INVENTION

Figure 1:
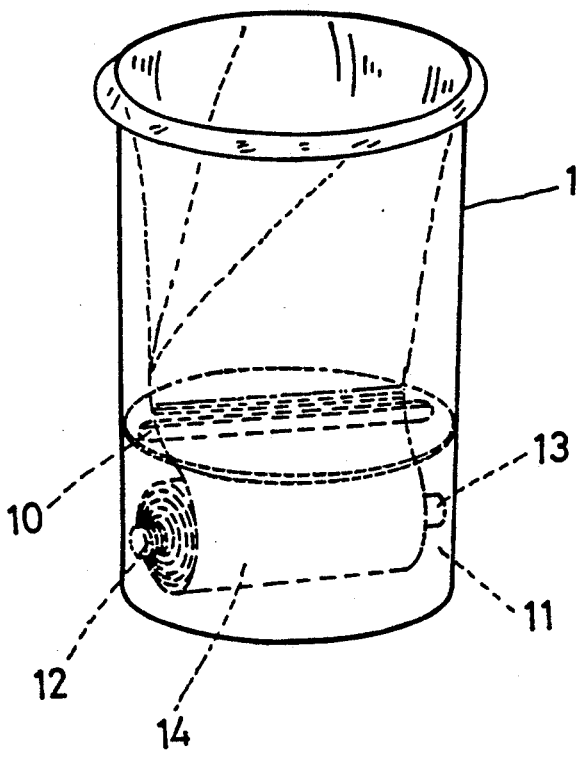
FIG. 1 is an exploded perspective view of a conventional garbage can.
Figure 2:
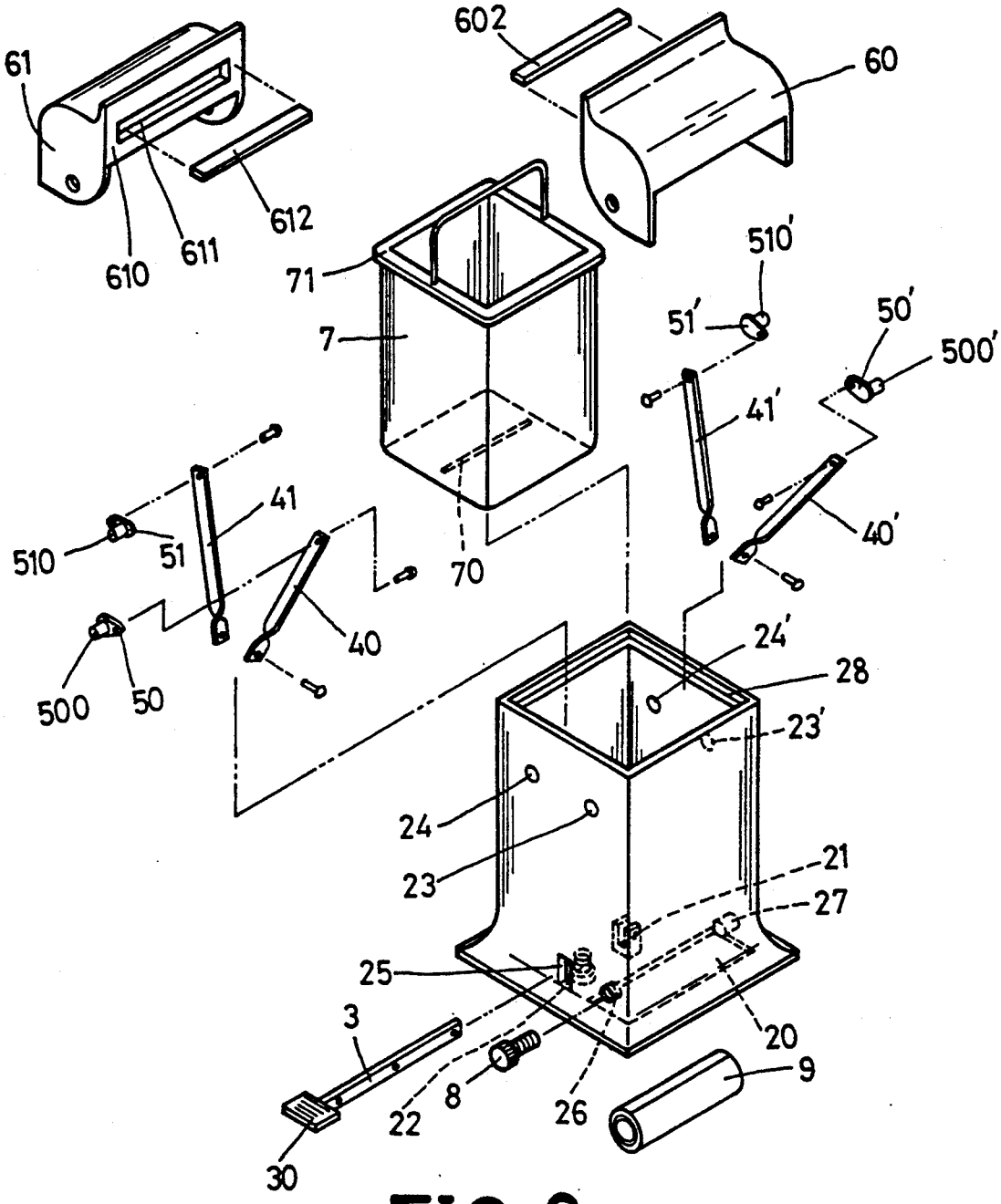
FIG. 2 is an exploded perspective view of a garbage can in the present invention.

A garbage can with garbage bags automatically deposited without manual handling in the present invention, as shown in FIG. 2, comprises an outer can 2, a lever 3, and an inner can 7, and two half caps 60, 61 and two pairs of connecting rods 40, 41, 40', 41' as its main components.

The outer can 2 is shaped preferably as a rectangular cross-section, having a rectangular opening in a bottom for a garbage bag roll 9 to pass through, a U-shaped supporter 21 on a central portion of the bottom, a coil spring 22 on a left side of the supporter 21 on the bottom, two round holes 23, 24, 23', 24' respectively in an upper portion of two opposite vertical side walls, a lever hole 25 in a lower portion of a left one of the two opposite side walls, a screw hole 26 beside the lever and near a corner, a round projection 27 on the inner side of a right one of the two opposite side walls in aligned location of the screw hole 26 in the left side wall, and a horizontal circumferential groove in an inner upper end of the outer can 2 for a circumferential flange of the inner can to engage hangingly.

The lever 3 is provided to extend through the lever hole 25 in the left side wall of the outer can 2, having its intermediate portion pivotally pined with the U-shaped supporter 21 fixed on the bottom of the outer can and its outer end connected integrally with a pedal 30 for a foot to step on to press down the lever 3 for opening the two half caps 60, 61. In order to dispose the lever 3 in place, the lever hole 25, the spring 22 and the U-shaped supporter 21 should be provided to align one another.

The two pairs of two connecting rods, a first pair 40, 41, and a second pair 40', 41' are provided, having their bottom ends pivotally connected with two vertical sides of the lever 3, and two pairs of position means. In the preferred embodiment, the position means is a plate. A first pair of positioning means 50, 51, and a second pair 50', 51', are respectively attached to pivotal shafts 500, 510, and pivotal shafts 500', 510' to fit through the round holes 23, 24, 23', 24' in the outer can 2. And the two pairs of the pivotal shafts 500, 510, 500', 510' are pivotally connected with upper ends of the two pairs of two connecting rods 40, 41, 40', 41'.

The position means plates 50, 51, and 50', 51' are connected to the connecting rods 40, 41, and 40', 41' by a pin which passes through a hole in the plates 50, 51, and 50', 51'. The hole is spaced from the pivotal shafts' central axis so that the connecting rods impart rotation to the pivotal shafts when the rods move up and down.

The two half caps 60, 61 respectively have a curved upper surface, two lateral opposite sides, a vertical longitudinal side 600, 610 abutting the curved upper surface to contact with each other when the two half caps 60, 61 are closed on the open upper side of the outer can, a hole in each of the two lateral opposite sides for receiving the pivotal shafts 500, 510, 500', 510'. The two vertical sides 600, 610 have two vertical long slots 601, 611 and adhesive long bars 602, 612 are provided to fit in the slots 601, 611 for adhering an upper end of a garbage bag placed in the inner can 7 from below the bottom thereof.

The inner can 7 is provided to be placed in the interior of the outer can 2, being hung around the circumferential groove 28, having the same shape of the outer can but a smaller size than that of the outer can 2, a long slot 70 in a bottom for garbage bags to pass through upward from a garbage bag roll stored below the inner can 7 on the bottom of the outer can 2, and a flange 71 to hang around the circumferential groove 28. After the inner can 7 is hung on the outer can 2, there is a space between the circumferential walls of both cans 2, 7, being wide enough for the connecting rods 40, 41, 40', 41' to be disposed in the space.

A screw button 8 is provided to thread in the screw hole 26 in the outer can 2 to support a roller for hanging a garbage bag roll 9 on the roller so as to be pulled upward through the slot 70 in the inner can 7.

Figure 3:
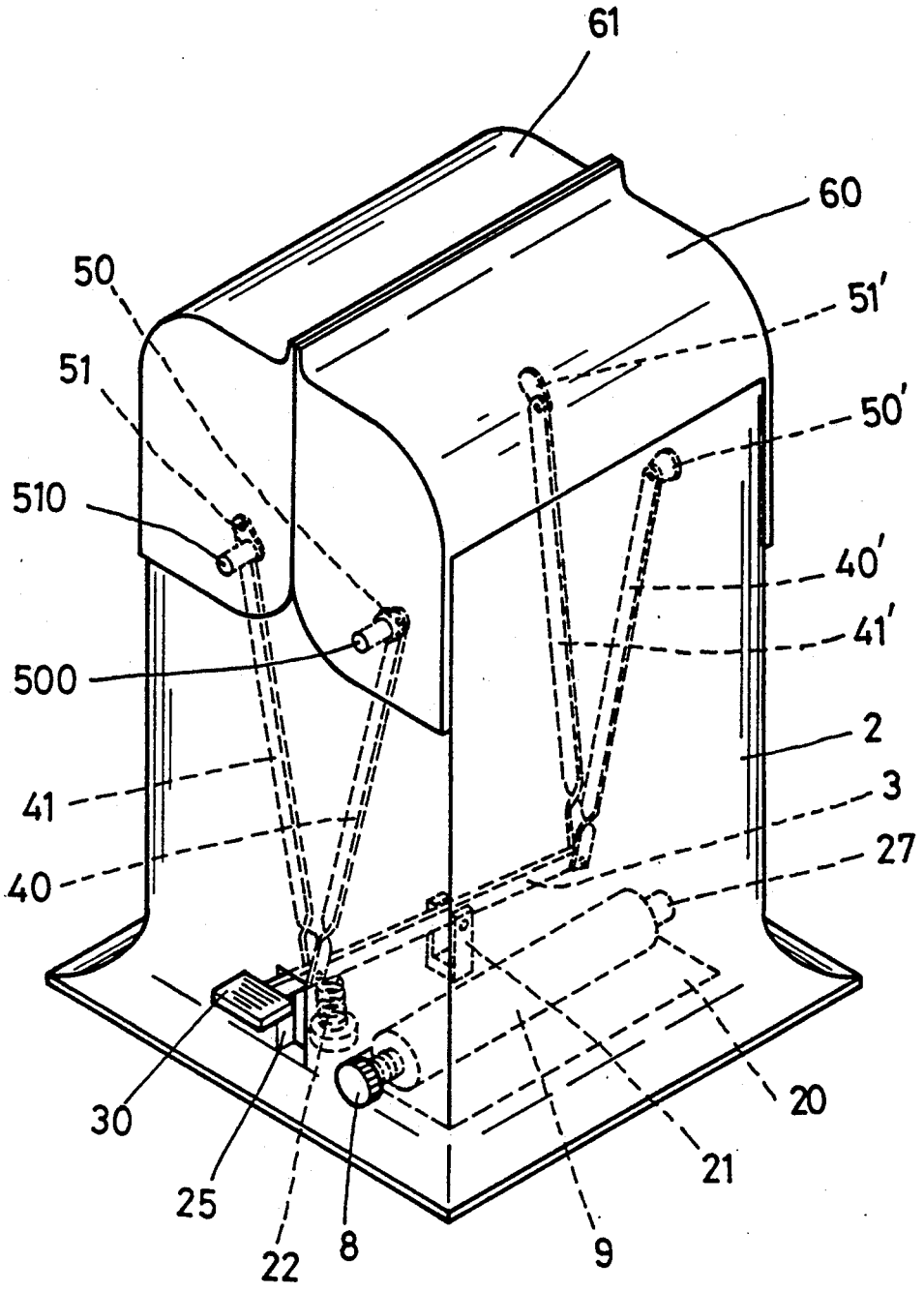
FIG. 3 is a perspective view of the garbage can in the present invention.

In assembling, as shown in FIG. 3, first, the lever 3 is inserted through the lever hole 25 to protrude through the U-shaped supporter 3 to be pivotally connected with a pin with the supporter 3. Next, the two pairs of two connecting rods 40, 41, 40', 41' are pivotally connected with both sides of the lever 3, and then the position means 50, 51, 50', 51' are pivotally connected with the top ends of the connecting rods 40, 41, 40', 41' and the two half caps 60, 61 are closed on the outer can 2 and the pivotal shafts 500, 500', 510, 510' of the position means 50, 50', 51, 51' are inserted from an inner side through the holes 23, 23', 24, 24' of the outer can 2 and the holes of the two opposite side walls of the inner can 7. After that, the inner can 7 is placed into the outer can 3, with the two half caps 60, 61 opened, and lastly, the garbage bag roll 9 with the roller is pushed through the opening 20 and one end of the roller is hooked by the round projection 27 and the other end thereof is screwed with the screw button 8 to secure the bag roll 9 with the roller so that the roll 9 can be pulled through the slot 70 in the inner can 7 for one garbage bag to be placed in the inner can 7 to receive garbage.

Figure 4:
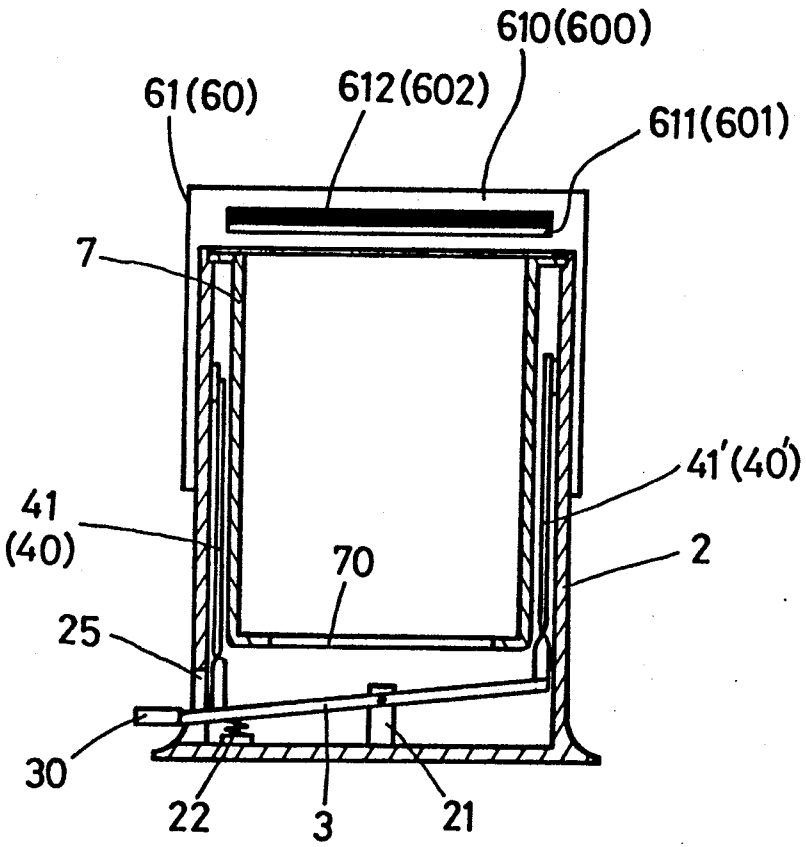
FIG. 4 is a front cross-sectional view of the garbage can with two half caps in opened condition in the present invention.
Figure 5:
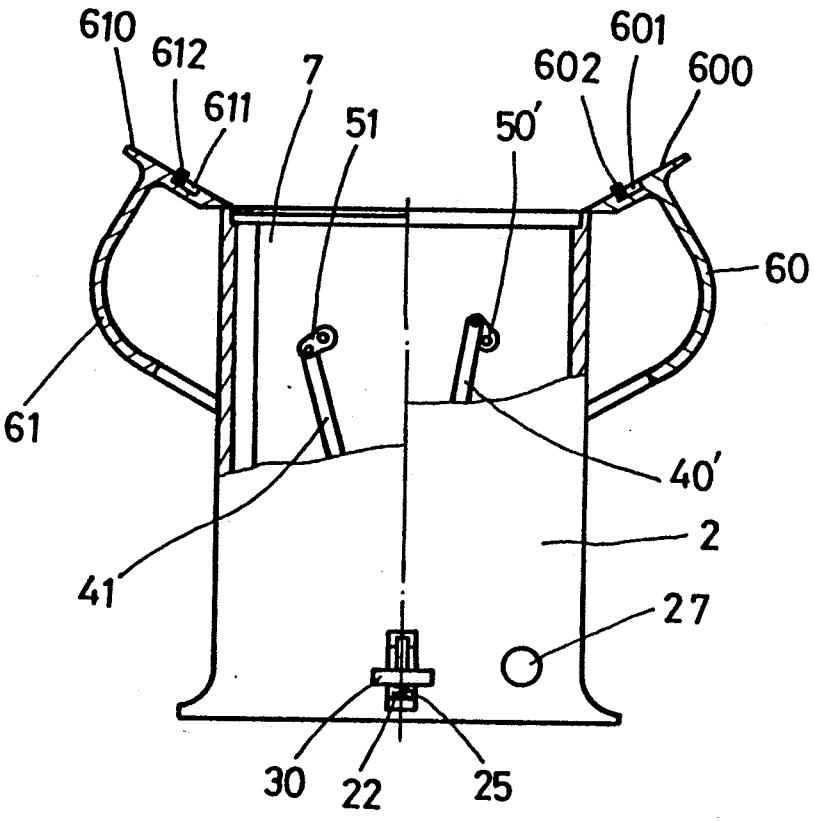
FIG. 5 is a side and partial cross-sectional view of the garbage can with the two half caps in opened condition in the present invention.

In using, as shown in FIGS. 4 and 5, a user steps down the pedal 30 of the lever 3, which then compresses the coil spring 22 to move down the first pair of the connecting rods 40, 41 but move up the second pair of the connecting rods 40', 41'. Then the pivotal shafts 500, 510 of the position means 50, 51 are moved to rotate clockwise in the holes 23, 24 by the connecting rods 40, 41 so that the half caps 60, 61, normally closed, may be forced to swing outward to open the open upper side of the outer can 2. Meanwhile, the pivotal shafts 500', 510' of the position means 50', 51' are moved to rotate counterclockwise in the holes 23', 24' so that the half caps 60, 61 may also be forced to swing outward to open the outer can 2 at the same time. Now as the half caps 60, 61 are open, garbage can be thrown into the garbage bag placed in the inner can 7.

If the user releases his/her foot from the pedal 30 so far stepped on, the lever 3 is pushed up by elasticity of the spring 22, letting the first pair of the connecting rods 40, 41 move up and moving down the second pairs of the connecting rods 40', 41' with the position means 50, 51, 50', 51' rotating counterclockwise and clockwise in the holes 23, 24, 23', 24' and forcing the half caps 60, 61 to swing inward to close up the outer can 2 by the pivotal shafts 500, 510, 500', 510' being rotated by the position means 50, 51, 50', 51 and partly by their own weight.

Figure 6:
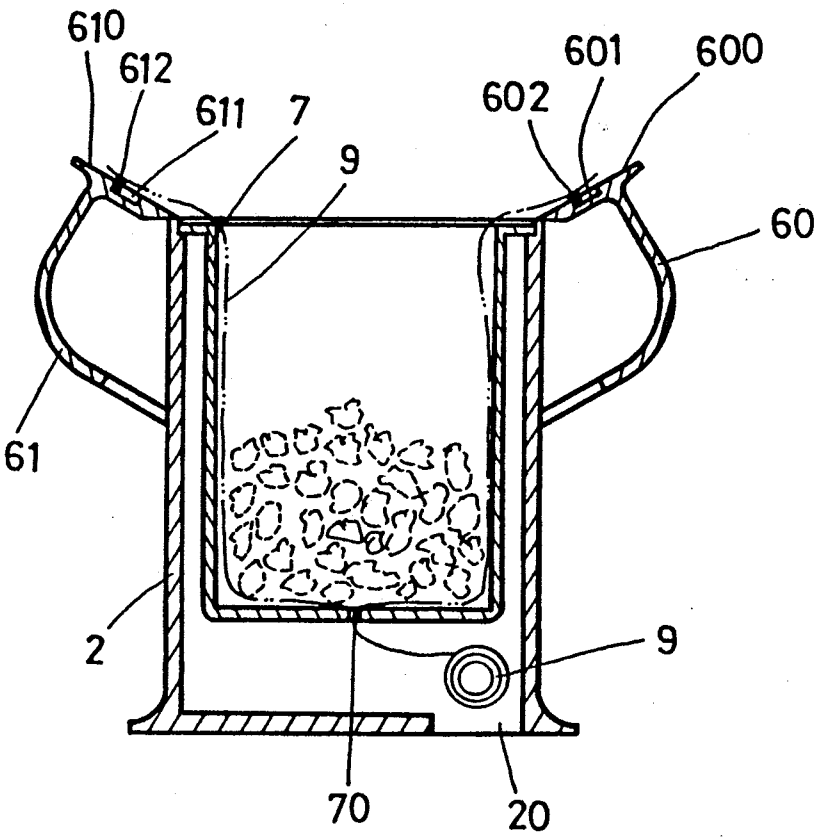
FIG. 6 is a side cross-sectional view of the garbage can with the two half caps opened for throwing garbage in a garbage bag placed in an inner can in the present invention.
Figure 7:
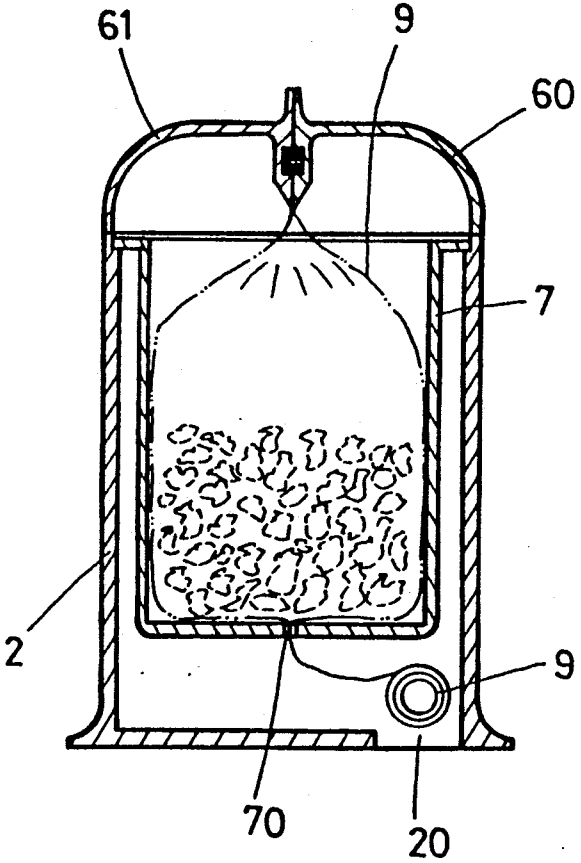
FIG. 7 is a side cross-sectional view of the garbage can with the two half caps in closed condition in the present invention.

The two adhesive bars 602, 612 fitted in the horizontal slots 601, 611 in the half caps 60, 61 can adhere to both sides of the upper end of the garbage bag 9 so that when the half caps are opened, two adhesive bars 602, 612 also open the garbage bag 9, with both the upper sides adhered to the bars 602, 612. And when the half caps 60, 61 are closed up on the outer can 2, the upper end of the bag adhered to the bars 602, 612 are also closed up without manual handling as shown in FIGS. 6 and 7.

Nearly any material with proper adhering properties will suffice for the adhesive bars 602, 612. Among the materials that can be used for the adhesive bars 602, 612 are PU resin, TPR, heat moldable rubber, etc.

When the garbage bag 9 in the inner can 7 becomes full, it can be taken out of the inner can 7 by removing the upper end adhered to the adhesive bars 602, 612, with the half caps 60, 61 opened. Then the next garbage bag 9 connected the full one taken out is to be pulled out through the slot 70 from the bottom of the outer can 2 and be placed in the inner can 7. Then the upper end can be adhered to the adhesive bars 602, 612 by closing the half caps 60, 61, and the full bag taken out can be torn off.

What is claimed is:

1. A garbage can with garbage bags automatically dispensed comprising:

an outer can having an open upper end, four vertical sides, and a bottom surface including a rectangular opening through which a roll of garbage bags is passed, two opposing sides of said four vertical sides each having two spaced shaft holes in an upper portion receiving two pivotal shafts of two position means, and further including a screw hole above said rectangular opening, and a circumferential horizontal groove around an inner surface at said upper end receiving an upper flange of an inner can so as to secure the inner can in the outer can;

the inner can having an open upper end, four vertical sides, and a bottom surface including an elongated slot through which said garbage bags pass from below;

an elongated lever provided with a pedal at a front end of the lever end, the lever extending through a lever hole in the outer can and being supported by a pivotal pin, the outer can including a coil spring positioned so as to urge the lever upward at its front end;

first and second half caps provided to close and open the upper end of the outer can, the half caps having a curved upper closed surface and two opposing sides, an inner edge of each opposing side of the first half cap abutting a corresponding inner edge of corresponding sides of the second half cap when in a closed position, an elongated slot being included in contacting faces of said half caps to receive an elongated adhesive bar to adhere to an upper end of one of said garbage bags, and further including a pivotal hole in each opposing side receiving said pivotal shafts therethrough and said pivotal shafts connect with the opposing sides to transmit rotation to the half caps;

a first pair of connecting rods having bottom ends pivotally connected to a front portion of the lever, a second pair of connecting rods having bottom ends pivotally connected to a rear portion of the lever, the first pair of the connecting rods having upper ends pivotally connected to said position means with said pivotal shafts of a first of said two opposing sides of the outer can, the second pair of connecting rods having upper ends pivotally connected with said position means with said pivotal shafts of a second of said two opposing sides of the outer can, the two pairs of connecting rods being disposed in the space defined between the sides of the inner and outer cans;

a screw button received into the screw hole to hold said roll of garbage bags; wherein said lever when not being urged downward by a user's foot, remains in a first position wherein said lever is nearly horizontal, the weight of said lever being support by the coil spring, and the two half caps remain closed due to the force of their own weight; and wherein when pressure is applied to said lever by the user's foot, the lever moves to a second position wherein it compresses the spring and raises the rear portion of the lever, causing said second pair of connecting rods to be moved up and the position means connected to the upper ends of said second pair of connecting rods rotates the pivotal shafts so that the two half caps swing outward so that the upper end of the outer can is uncovered and said upper end of one of said garbage bags positioned in the inner can is opened due to its adhering to the adhesive bars of the two half caps.

2. The garbage can as claimed in claim 1 wherein:

the two half caps have at least two adhesive bars fitted therein to reinforce the function of adhering the upper end of each garbage bag to be opened and closed with said half caps.

3. The garbage can as claimed in claim 1 wherein:

said adhesive bars are made of a material with strong adhesive properties.

* * * * *